United States Patent [19]

Byars

[11] Patent Number: 5,039,026

[45] Date of Patent: Aug. 13, 1991

[54] YARN PACKAGE HOLDER

[75] Inventor: Larry W. Byars, Greenville, S.C.

[73] Assignee: Exim, Ltd., Greenville, S.C.

[21] Appl. No.: 511,797

[22] Filed: Apr. 20, 1990

[51] Int. Cl.[5] ..... B65H 49/06

[52] U.S. Cl. ..... 242/130; 242/129.7; 242/131

[58] Field of Search ..... 242/130, 130.1, 130.2, 242/130.3, 130.4, 131, 131.1, 129.5, 129.7, 129.71, 134, 139, 141, 55.2, 55.54, 68

[56] References Cited

U.S. PATENT DOCUMENTS

| | | | |
|---|---|---|---|
| 1,508,105 | 9/1924 | Kamla | 242/130.1 X |
| 2,283,373 | 5/1942 | Krafft | 242/130.1 X |
| 2,437,888 | 3/1948 | Narki | 242/129.7 |
| 4,728,055 | 3/1988 | Wright, Jr. et al. | 242/130 |
| 4,760,977 | 8/1988 | Wright, Jr. et al. | 242/130 |
| 4,824,042 | 4/1989 | Whitaker et al. | 242/130 |
| 4,880,184 | 11/1989 | Crow | 242/130 |

*Primary Examiner*—Stanley N. Gilreath
*Attorney, Agent, or Firm*—Brady, O'Boyle & Gates

[57] ABSTRACT

A yarn package holder for accommodating yarn package tubes and cones of various sizes, wherein a contact arm has one end of a first spring member pivotally connected to the distal end thereof, and one end of a second spring member fixedly connected to the one end thereof. The free end of the first spring member engages the inner wall surface of the tube or cone, and the free end of the second spring member engages the first spring member intermediate the ends thereof to provide a displaceable fulcrum therewith. An equal biasing force is applied to the inside surface of the tubes or cones no matter what their size might be.

6 Claims, 3 Drawing Sheets

FIG.1
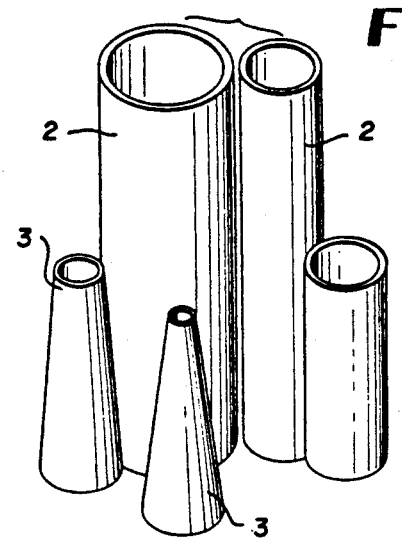
FIG.2
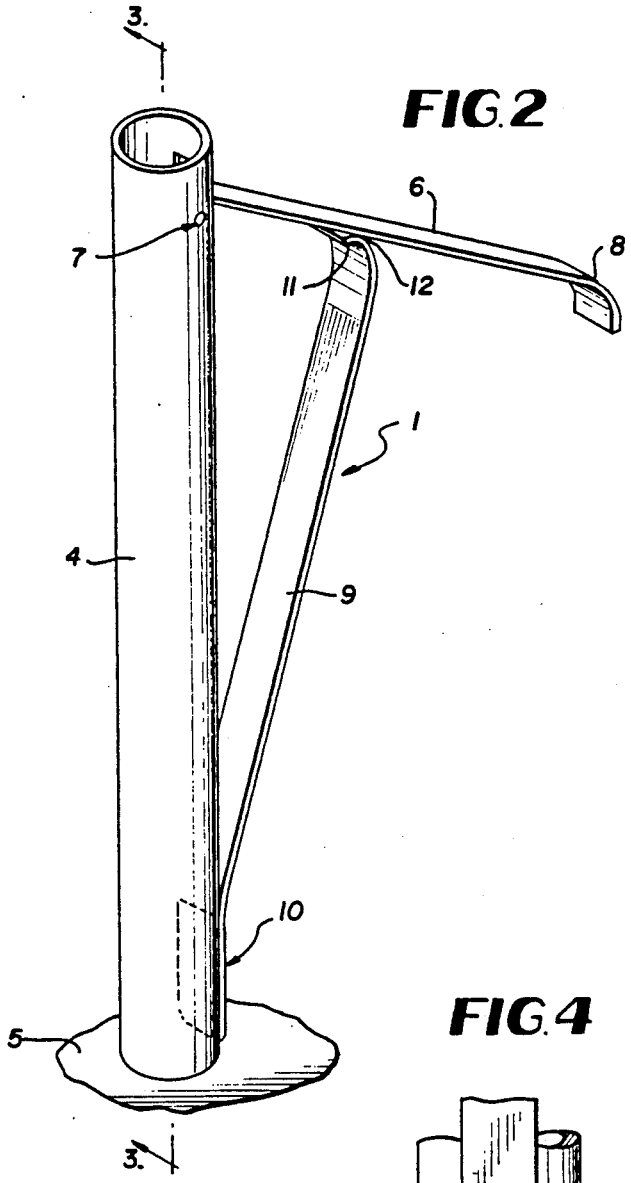
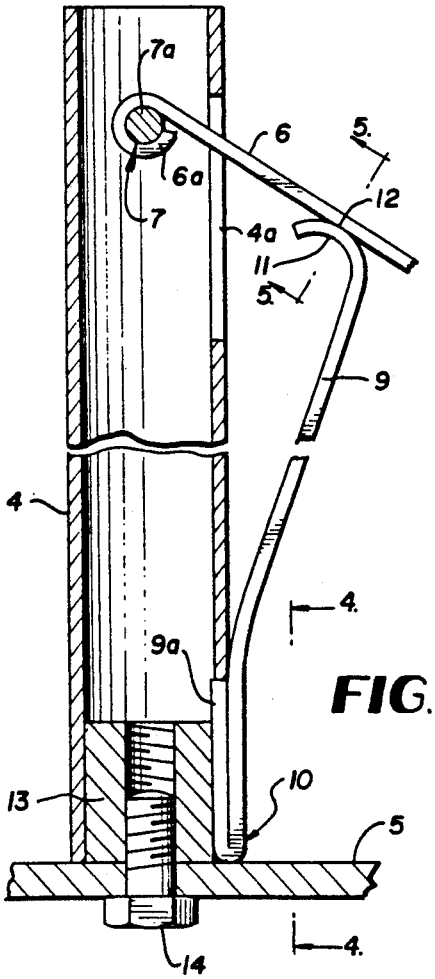
FIG.3
FIG.4
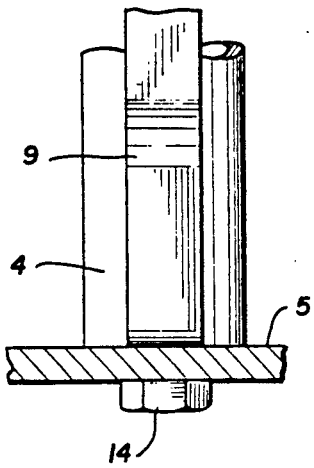

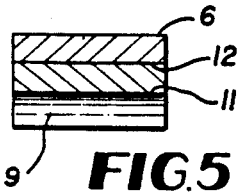
FIG.5
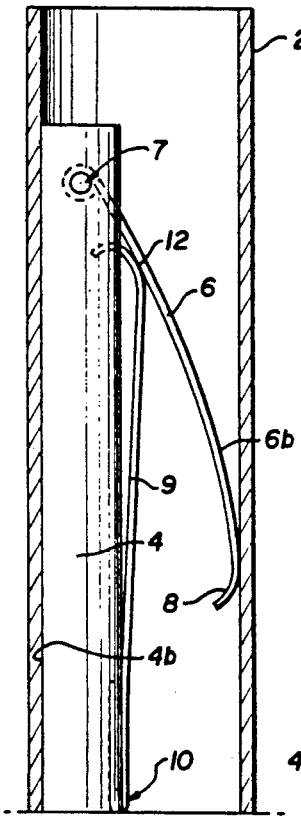
FIG.7
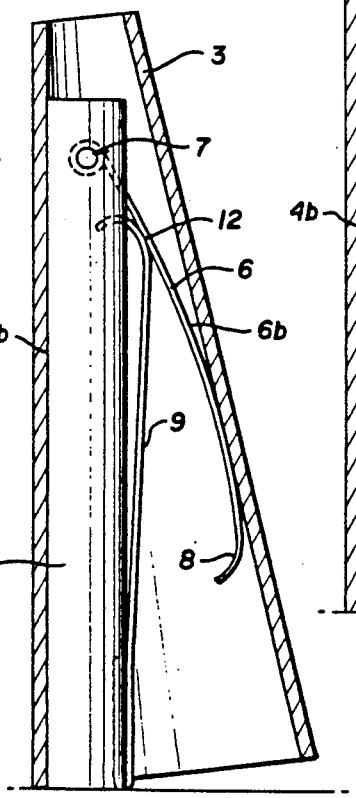
FIG.8
FIG.6
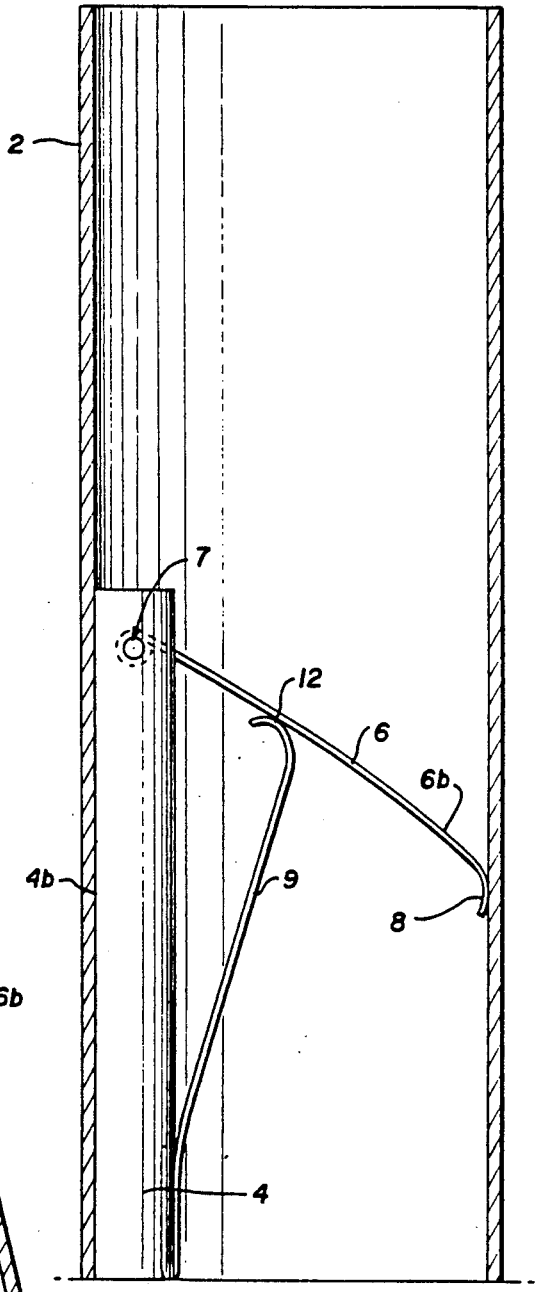

FIG.9
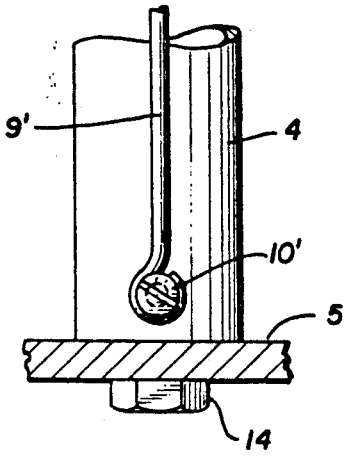
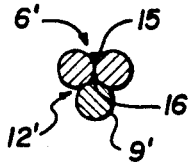
FIG.10
FIG.11
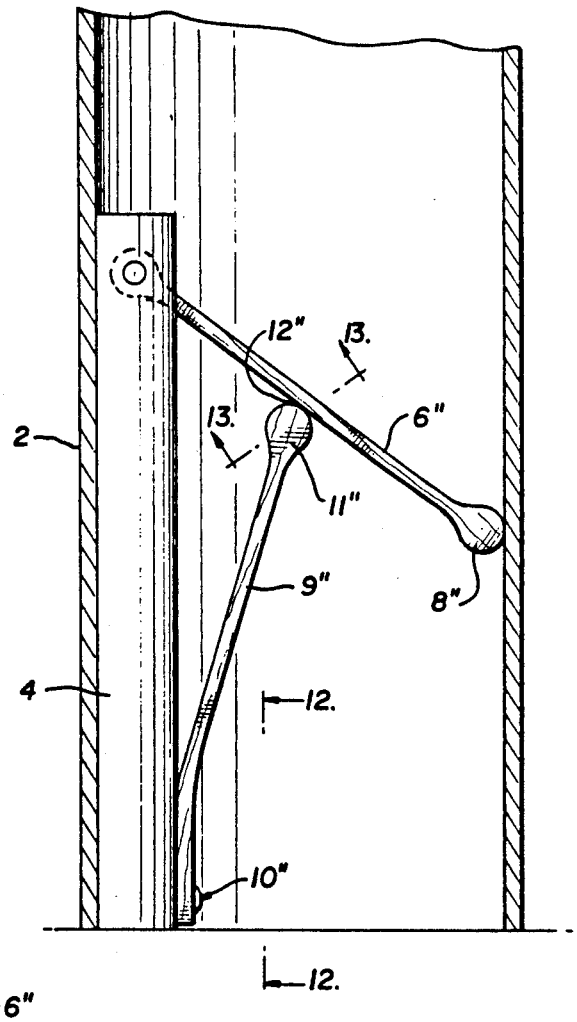
FIG.2
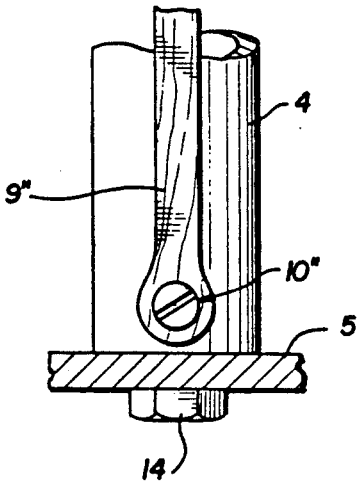
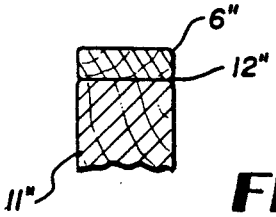
FIG.13

YARN PACKAGE HOLDER

BACKGROUND OF THE INVENTION

This invention relates to a yarn package holder for textile machines having a creel to support and hold cylindrical and conical tubes upon which the yarn is wound to form a yarn package, and from which the yarn is withdrawn during operation of the machine.

In order to accommodate yarn package tubes having various diameters, holders have been provided having arms or legs which are biased radially outwardly to engage the inner surface of the hollow tube upon which the yarn is wrapped. The biasing force is obtained either by the inherent resiliency of the material from which the arms or legs are made, as disclosed in U.S. Pat. No. 2,283,373, dated May 19, 1942, or by a spring engaging the arm for biasing the arm radially outwardly as disclosed in U.S. Pat. Nos. 4,728,055, dated Mar. 1, 1988, and 4,760,977, dated Aug. 2, 1988.

While these holders facilitate the installation and removal of the package on the creel with one hand, they have been characterized by certain disadvantages; particularly, the necessity of forcing the arms or legs of the holder against the inside surface of the cone or tube. Most cones or tubes used in the textile industry are made of paper or plastic, and when forced over such holders, the pressure against the inside surface of the cone or tube is so great that it causes damage to the tube or cone. The smaller the size of the tube or cone that is placed over such holders, the greater the pressure against the radially outwardly biased arms or legs of the holder consequently, it has heretofore been impossible to provide a holder which fits all commonly used sizes of yarn packages. If the holder was made large enough to hold large yarn packages, it would be impractical to hold small packages, because the radially outwardly biased arms or legs would subject the small tube or cone to excessive internal pressure resulting in the tube or cone being torn or worn. This is particularly so when the textile machinery is being operated in an atmosphere of very high humidity which is often the case, since some yarns are stronger when wet.

In order to accommodate the holder to both small and large yarn packages, it has been proposed to provide the holder with a plurality of arms of various sizes to accommodate the respective large and small yarn packages, as disclosed in the aforementioned U.S. Pat. No. 4,760,977, or to provide the base support arm of the holder with a detachable spacer bar, as disclosed in the aforementioned U.S. Pat. No. 4,728,055. Neither proposal has proven satisfactory because the plurality of variously-sized arms do not provide uniform internal pressure for all sizes of yarn packages, and the detachable spacer bar resulted in an increase of time and expense to handle the installation of the spacer bar to accommodate larger packages, and the removal of the spacer bar to accommodate smaller packages.

After considerable research and experimentation, the yarn package holder of the present invention has been devised for accommodating all sizes of yarn package tubes or cones and providing uniform holding pressure, to thereby prevent damage to the internal surface of the tubes or cones by excess internal pressure.

The yarn package holder of the present invention comprises, essentially, a contact arm or rod connected in a cantilevered manner to a base support which is operatively connected to a creel. The contact arm engages the inside surface of the yarn package tube or cone, and one end of a spring member is pivotally connected to the distal end portion of the contact arm and extends therefrom in a direction toward the proximate end of the contact arm. A second spring member has one end fixedly secured to the proximate end portion of the contact arm and extends therefrom in a direction toward the distal end of the contact arm. The end portion of the second spring member engages the first spring member and biases it radially outwardly, whereby tubes and cones of various sizes can be mounted on the contact arm.

The spring members may consist of steel, wood or plastic leaf springs, or steel wire springs.

BRIEF DESCRIPTION OF THE DRAWINGS

FIG. 1 is a perspective view showing the various shaped yarn tubes adapted to be held by the holder of the present invention;

FIG. 2 is a perspective view of one embodiment of the holder of the present invention:

FIG. 3 is a fragmentary side elevational view of the holder shown in FIG. 2;

FIG. 4 is a view taken along line 4—4 of FIG. 3;

FIG. 5 is a view taken along line 5—5 of FIG. 3;

FIG. 6 is a side elevational view of a relatively large diameter yarn tube mounted on the holder illustrated in FIG. 2;

FIG. 7 is a side elevational view of a relatively small diameter yarn tube mounted on the holder illustrated in FIG. 2;

FIG. 8 is a side elevational view of a conical yarn holder mounted on the holder illustrated in FIG. 2;

FIG. 9 is a fragmentary, side elevational view similar to FIG. 4 showing another embodiment of the holder wherein the cantilevered spring members are formed of wire;

FIG. 10 is a sectional view similar to FIG. 5, showing the embodiment illustrated in FIG. 9;

FIG. 11 is a fragmentary, sectional, side elevational view showing still another embodiment of the holder wherein the cantilevered spring members are formed from wood;

FIG. 12 is a view taken along line 12—12 of FIG. 11; and

FIG. 13 is a view taken along line 13—13 of FIG. 11.

DESCRIPTION OF THE PREFERRED EMBODIMENTS

Referring to the drawings, and more particularly to FIGS. 1 and 2, the yarn package holder 1 of the present invention is readily adapted to hold yarn package tubes 2 and yarn package cones 3 of various sizes, and comprises, a contact arm or rod 4 connected to a base support 5 in a cantilevered manner, it being understood by those skilled in the art that the base support 5 is operatively connected to a creel, not shown.

A first leaf spring 6 has one end pivotally connected to the distal end portion of the contact arm 4 as at 7, and extends outwardly therefrom with the free end thereof having a bent portion 8 adapted to engage the inner wall surface of a package tube 2 or cone 3, to be described more fully hereinafter. A second leaf spring 9 has one end fixedly secured to the proximate end portion of the contact arms 4, as at 10, FIG. 3, and extends therefrom in a direction toward the distal end of the contact arm 4. The free end of the second leaf spring 9 is also provided with a bent portion 11 which engages the first leaf spring as at 12.

The details of the construction of the contact arm 4, the pivotal connection 7 and fixed connection 10 are illustrated in FIG. 3, wherein it will be seen that the contact arm 4 comprises an open ended tubular member having a slot 4*a* provided in the wall thereof through which the first leaf spring 6 extends, the pivotal connection 7 being provided by a diammetrically extending pin 7*a* fixedly mounted in the contact arm, the end 6*a* of the leaf spring being bent around the pin 7*a*.

The fixed connection 10 comprises a reversely bent portion 9*a* provided on the end of the second leaf spring 9 which extends into the tubular arm 4 and is held therein by a long hex nut 13 press-fit into the tubular arm 4. The tubular arm 4 is secured to the base support plate 5 by a bolt 14 extending through the base support and threaded into the nut 13.

The operation of the holder embodiment shown in FIGS. 2 and 3 is illustrated in FIGS. 6, 7 and 8, wherein it will be seen that the holder is readily adaptable for holding yarn package tubes 2 of various sizes, FIGS. 5 and 6, as well as yarn package cones 3, FIG. 8, wherein one side of the inner surface of the tube or cone engages a surface 4*a* of the contact arm 4 and the free end of the leaf spring 6 engages the opposite side of the inner surface of the tube or cone. When the yarn package tubes 2 or cones 3 are placed on the free end of the contact arm 4, the leaf springs 6 and 9 slide against each other as the package is being installed. As will be seen in FIGS. 5 to 6, the point of contact 12 between the springs or fulcrum is displaced in direct relation to the inside diameter of the respective tube or cone. Thus, for instance, in FIG. 7, the fulcrum point 12 is closer to the pivotal connection 7 when a tube of small diameter is mounted on the holder, than when a tube of large diameter is mounted thereon, as shown in FIG. 6. By this construction and arrangement, an equal biasing force is applied to the inside surface of the tubes or cones, throughout the whole range of movement of the leaf springs 6 and 9, no matter what their size might be. In other words, no greater pressure is applied to a tube or cone with a 1½" inside diameter than is applied to a yarn package tube or cone having a 3" inside diameter.

In order to further enhance the holding of the tube 2 or cone 3 on the holder, the contact arm surface 4*b* and the tube engaging surface 6*b* of the leaf spring 6 may be knurled or roughened to increase the frictional engagement with the inner surface of the tube or cone.

While the embodiment of the holder as shown and described in connection with FIGS. 2 to 8 employs metallic leaf springs 6 and 9, FIGS. 9 and 10 disclose another embodiment wherein the spring members 6' and 9' comprise wires. Wire spring 9' is fixedly connected to the contact arm 4 as at 10', and wire spring 6' consists of a pair of wires welded together as at 15, the trough 16 being formed therein providing the point of contact 12' or fulcrum between the wire springs 9' and 6'.

Still another embodiment of the invention is illustrated in FIGS. 11, 12 and 13, wherein the spring members 6" and 9" are formed from wood. Spring member 9" is fixedly secured to the end of the contact arm, as at 10". The spring member 6" is pivotally connected to the contact arm 4 as at 7", and the free ends of each of the spring members are provided with bulbous portions 11" and 8", for engaging, respectively, the spring member 6" and the inside wall surface of the tube 2.

From the above description, it will be readily apparent to those skilled in the art that the construction and arrangement of the spring members in the yarn package holder of the present invention provide an improved holder wherein an equal biasing holding force is employed for all sizes of yarn package tubes or cones than heretofore provided by known holders, wherein more force is applied against smaller tubes or cones than larger tubes when placed on the same holder. Furthermore, by employing flat or longitudinally extending wire spring members, the spring members can be folded into a much smaller space than obtainable by using other types of springs, such as coil springs, thus increasing the range of package sizes installable on the holder.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A holder for receiving and frictionally securing packages of yarn wound onto hollow tubes and cones of various inner diameters comprising, a base support adapted to be attached to a creel for a textile machine, a contact arm for contacting an inside wall of a selected yarn tube and cone, one end of said contact arm being rigidly connected to said base support, said contact arm extending from said base support in a cantilevered manner, a first spring member, a pivot connecting one end of said first spring member to the distal end portion of the contact arm, the free end of said first spring member extending in a direction toward said one end of the contact arm, a second spring member positioned between said contact arm and said first spring member, means fixedly connecting one end of said second spring member to said one end of said contact arm, said second spring member extending from said fixed connection in a direction toward the distal end portion of the contact arm, the other end of the second spring member engaging the first spring member to form a displaceable fulcrum therewith, the second spring member biasing the first spring member radially outwardly of said control arm, whereby a surface of the contact arm and the free end of said first spring member are urged against opposite inside wall surfaces of the selected tube and cone, to thereby apply an equal biasing force to the inside surface of the tubes and cones no matter what their size might be.

2. A yarn package holder according to claim 1, wherein the spring members comprise metallic leaf springs.

3. A yarn package holder according to claim 1, wherein the spring members comprise longitudinally extending wires.

4. A yarn package holder according to claim 3, wherein the first spring member comprises a plurality of side-by-side wires integrally connected, and the second spring member comprising a single wire.

5. A yarn package holder according to claim 1, wherein the spring members are formed from wood.

6. A yarn package holder according to claim 1, wherein the means fixedly connecting one end of the second spring member to said one end of the contact arm comprises, a reversely bent portion on said one end of said second spring member, said reversely bent portion extending into said one end of the contact arm, and a nut secured in said one end of said contact arm for frictionally holding the reversely bent portion of the second spring member therein, and a bolt extending through said base support and threaded into said nut.

* * * * *